US006989730B1

(12) United States Patent
Leupold

(10) Patent No.: US 6,989,730 B1
(45) Date of Patent: Jan. 24, 2006

(54) ADJUSTABLE TOROIDAL MAGNET

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/136,761

(22) Filed: May 24, 2005

(51) Int. Cl.
*H01F 7/02* (2006.01)

(52) U.S. Cl. ..... 335/306

(58) Field of Classification Search ..... 335/210, 335/302–306; 315/5.34, 5.35, 502, 504; 372/2, 21

See application file for complete search history.

(56) References Cited

U.S. PATENT DOCUMENTS 4,538,130 A * 8/1985 Gluckstern et al. ..... 335/306
4,837,542 A 6/1989 Leupold
4,862,128 A * 8/1989 Leupold ..... 335/306
5,103,200 A 4/1992 Leupold
5,666,098 A * 9/1997 Leupold ..... 335/306

* cited by examiner

*Primary Examiner*—Ramon M. Barrera
(74) *Attorney, Agent, or Firm*—Michael Zelenka; Roger C. Phillips

(57) ABSTRACT

In accordance with an embodiment of the present invention, a permanent magnet, includes a body that has a body axis and that, in turn, has a plurality of discreet components. Each of the components may be radially spaced from the body axis approximately an equal distance and each component may be circumferentially spaced an approximately equal distance apart. Also, each of the components may include a cavity and a component axis and wherein each of the components may have an inner body, that, in turn, has a magnetic substance and that is rotatable about the component axis and a plurality of inner segments each having an inner segment magnetic field. The components may also include an outer body that, in turn, includes a magnetic substance and that is rotatable about the component axis. The outer body may also have a plurality of outer segments each having an outer segment magnetic field and the outer body being located in proximity to the inner body whereby each of the inner segment magnetic fields and the outer segment magnetic fields interact.

11 Claims, 4 Drawing Sheets

ADJUSTABLE TOROIDAL MAGNET

GOVERNMENT INTEREST

The invention described herein may be manufactured, used, imported, sold, and licensed by or for the Government of the United States of America without the payment of any royalty thereon or there for.

BACKGROUND OF THE INVENTION

1. Field of the Invention

The present invention relates generally to permanent magnets and, more particularly, to permanent magnets capable of being adjusted to vary a magnetic field strength.

2. Related Art

Permanent magnets for use where a highly uniform magnetic field is required, such as in magnetic resonance imaging devices and traveling wave tubes, are known. Examples of such permanent magnets may be found in U.S. Pat. No. 4,837,542 to Leupold, entitled "Hollow Substantially Hemispherical Permanent Magnet High-Field Flux Source For Producing a Uniform High Field"and U.S. Pat. No. 5,103,200 to Leupold, entitled "High-Field, Permanent Magnet Flux Source". The permanent magnets described in those patents produce unusually high fields in their interiors. In the latter example patent, a hollow magic cylinder comprises an annulus that is magnetized so that the direction angle of magnetization $\gamma$ is twice the local coordinate $\theta$ or $\gamma=2\theta$.

It is also known to modify a magic cylinder to obtain a twister or a wiggler. For example, U.S. Pat. No. 4,862,128 to Leupold, entitled "Field Adjustable Transverse Flux Sources", and incorporated hereby by reference, concerns a permanent magnet with a variable field strength created by an axial sequence of two concentric magic rings of equal magnetic field output. Individual rings of each concentric pair are mutually rotatable with respect to each other whereby the magnetic fields of each concentric magic ring add by vector addition or subtraction to augment or diminish the combined magnetic field strength.

SUMMARY OF THE INVENTION

In accordance with one embodiment of the present invention, a permanent magnet, comprises a body that has a body axis and that, in turn, comprises a plurality of discreet components. Each of the components may be radially spaced from the body axis approximately an equal distance and each component may be circumferentially spaced an approximately equal distance apart. Also, each of the components may comprise a cavity and a component axis and wherein each of the components may comprise an inner body, that, in turn, comprises a magnetic substance and that is rotatable about the component axis and a plurality of inner segments each having an inner segment magnetic field. The components may also comprise an outer body that, in turn, comprises a magnetic substance and that is rotatable about the component axis. The outer body may also comprise a plurality of outer segments each having an outer segment magnetic field and the outer body being located in proximity to the inner body whereby each of the inner segment magnetic fields and the outer segment magnetic fields interact.

In accordance with another embodiment of the present invention, a permanent magnet comprises a toroidal body having a body central axis. The toroidal body may comprise an inner body that includes a magnetic substance and that is rotatable about an inner body central axis. The inner body may comprise a plurality of inner segments that each include an inner segment magnetic field. The toroidal body may also comprise an outer body that, in turn, comprises a magnetic substance and that is rotatable about an outer body central axis. The outer body comprises a plurality of outer segments that each include an outer segment magnetic field and the outer body is located in proximity to the inner body whereby each of the inner segment magnetic fields and the outer segment magnetic fields interact.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a permanent magnet that is adjustable to provide for the selection of various field strengths along a cavity of thereof. The permanent magnet may comprise a generally toroidal outer configuration and may comprise a plurality of individual components each of which may be rotatable about a transverse axis thereof.

Figure 1:
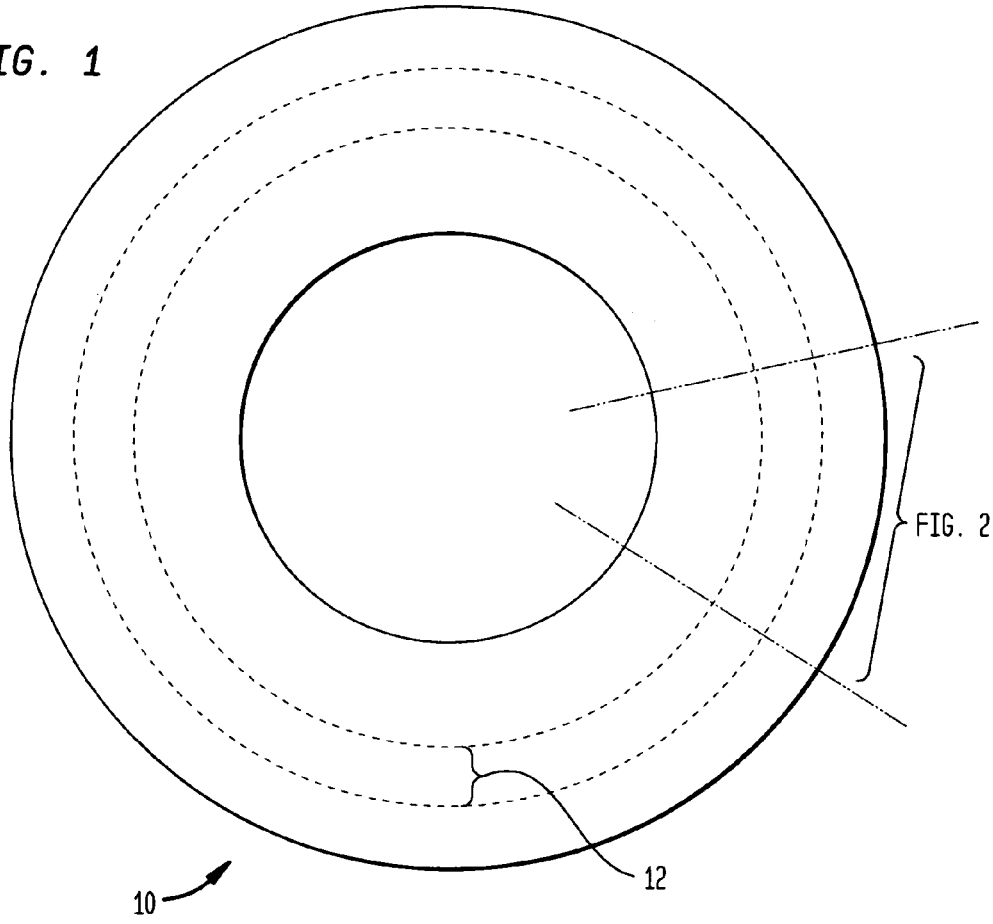
FIG. 1 is a top view of a toroidal permanent magnet in accordance with an embodiment of the present invention.
Figure 2:
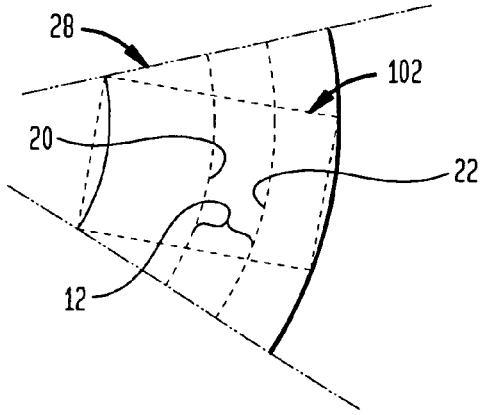
FIG. 2 is a top view of a portion of the toroidal magnet of FIG. 1.
Figure 3:
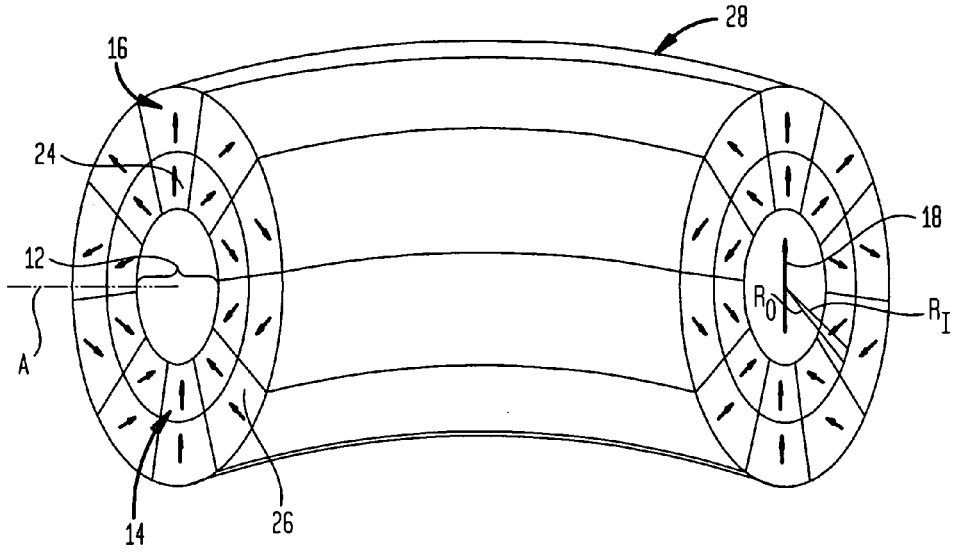
FIG. 3 is a front view of the portion of the toroidal magnet of FIG. 2.

A permanent magnet having a generally toroidally shaped body is illustrated generally at 10 in FIG. 1. Referring also to FIGS. 2 and 3, the permanent magnet 10 may comprise a central cavity 12, an inner body 14 and an outer body 16. The inner body 14 and the outer body 16 may each comprise a flexible and a magnetic material such as a cobalt-rare earth or a rare earth-iron. Each of the inner body 14 and the outer body 16, may be separably rotatable about an axis A in a manner similar to that described in U.S. Pat. No. 4,862,128 incorporated herein by reference and described below in connection with FIG. 5. The inner body 14 has an outer radius $R_O$ that is substantially equal in length to an inner radius $R_I$ of the outer body 16, although, it will be understood that a slight difference may be provided to allow for the rotations of the inner and outer bodies. It will be understood that a transverse magnetic field, represented by an arrow 18 within the central cavity 12, may remain almost the same as that in a corresponding unbent cylindrical magnet, such as that described in U.S. Pat. No. 4,862,128, although, the field may taper slightly from a smaller value on an inner extreme 20 of the central cavity to a slightly larger one on an outer extreme 22. Although not shown as such, it will be understood that, in practice, a portion of the permanent magnet 10, may be removed in order to provide access to the central cavity 12.

The inner body 14 of the permanent magnet 10 has a direction of magnetization represented by arrows 24 and an outer body 16 having a direction of magnetization represented by arrows 26. It will be understood that each direction of magnetization varies in a known manner such that an angle of magnetization $\gamma$ is twice a local coordinate $\theta$ or $\gamma=2\theta$.

In operation, rotation of the inner body 14 with respect to the outer body 16 allows for variation in field strength within a portion of the central cavity 18 as a, e.g., a magnetic particle travels through the central cavity 12. Reference may be had below to the description provided in connection with FIG. 5 which functions in a similar manner to the permanent magnet 10 and to U.S. Pat. No. 4,862,128, incorporated herein by reference.

Figure 4:
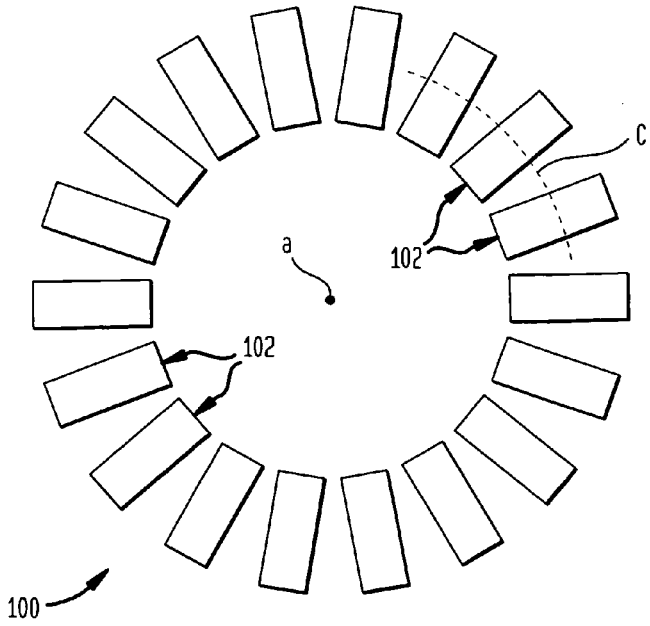
FIG. 4 is a diagram showing a permanent magnet comprising a plurality of components in accordance with another embodiment of the present invention.

Referring now to FIG. 4, another embodiment of a permanent magnet in accordance with the present invention, which provides for additional adjustment to an internal magnetic field while retaining a generally toroidal configuration, is illustrated generally at 100. The permanent magnet 100 may function as a radial particle accelerator and comprises a plurality of discreet components 102 radially spaced from a central axis (a) and generally equally spaced apart. Each component 102 may be interconnected via a moldable substance such as a plastic (not shown) and may comprise a configuration that, it will be appreciated, provides for rotation of each about an axis (c). The axis (c) may form a central axis of the components as illustrated, although, an eccentric axis is contemplated by the present invention.

Figure 5:
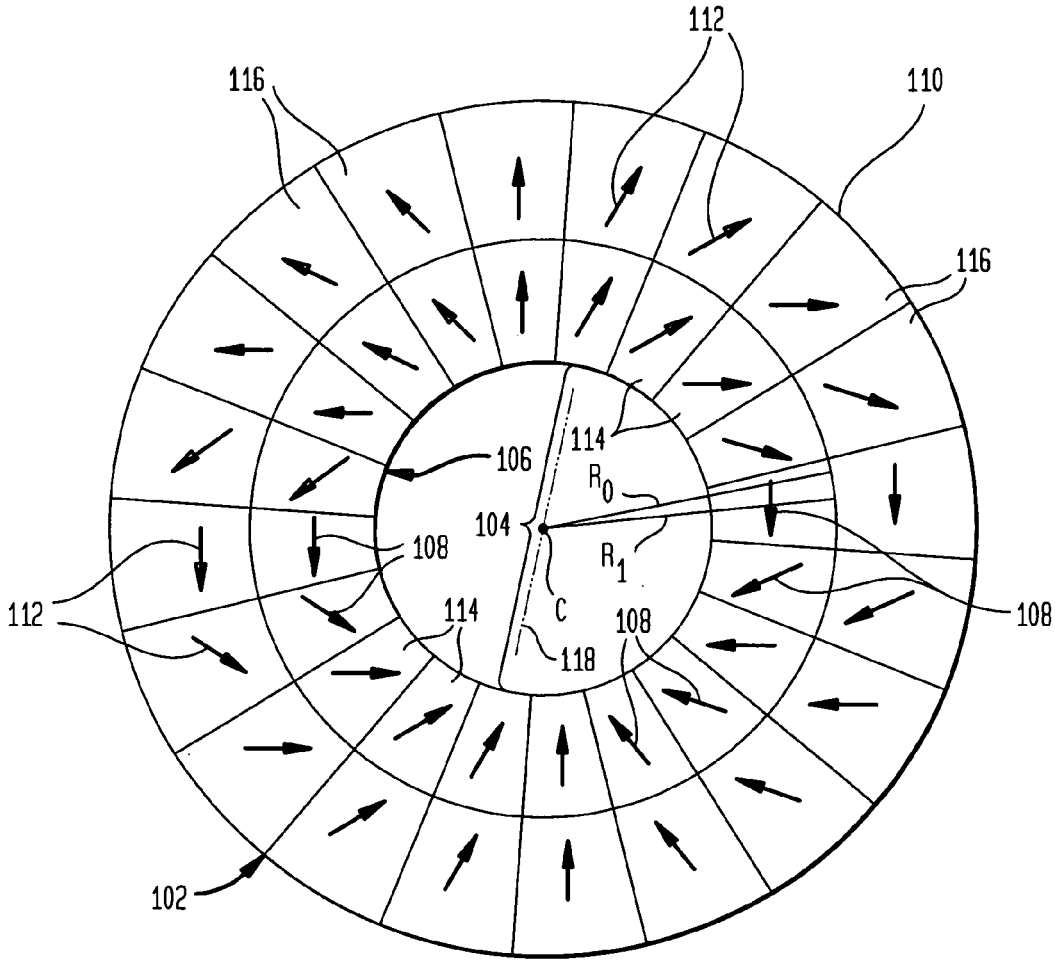
FIG. 5 is a diagram showing an end view of one component of the permanent magnet of FIG. 4.

Referring now to FIG. 5, which shows an end view of each component 102, it will be appreciated that each component may comprise a generally disk-like shape and a magnetic material such as that comprising a rare earth material. Each component may also comprise a central cavity 104, an inner body 106 having a direction of magnetization represented by arrows 108 and an outer body 110 having a direction of magnetization represented by arrows 112. The inner body 106 and the outer body 110 are each separably rotatable about the axis (c) and each cylinder comprises a number of segments 114,116 each having a generally trapezoidal configuration. The inner body 106 has an outer radius $R_O$ that is substantially equal in length to an inner radius $R_I$ of the outer body 110, although, it will be understood that a slight difference may be provided to allow for the rotations of the inner and outer bodies. It will also be understood that the inner and outer bodies 106,110 may be generally tubular in configuration.

In operation, rotation of the inner body 106 with respect to the outer body 110 allows for variation in field strength, represented by arrow 118, within portions of the central cavity 104. In particular, through vector addition, each adjacent segment of each inner and outer body may be combined to provide a particular magnitude and direction of the combined magnetic field.

Figure 6:
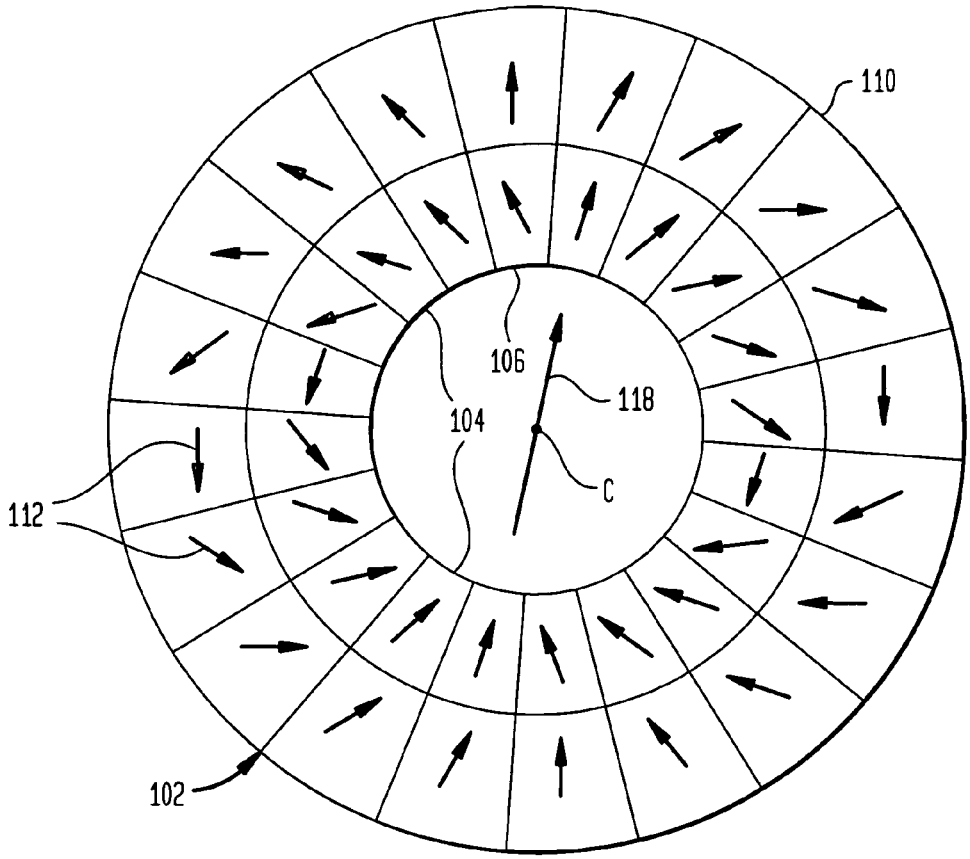
FIG. 6 is a diagram showing the component of FIG. 5 with an inner body of the component rotated about an axis c with respect to an outer body.

Referring now to FIG. 6, one example adjustment in field strength through the central cavity 104 possible with the component 102 of the permanent magnet 100 is shown. In this example, the inner body 106 is rotated with respect to the outer body 110 whereby, through vector addition, a slight variation in the direction of the magnetic field, represented by arrow 118, through the central cavity 104 results. It will be appreciated that when multiple components 102 of the permanent magnet 100 are adjusted to provide varying field directions, a magnetic particle traveling through each central cavity 104 may be caused to "wiggle".

Referring now to FIG. 2, a trapezoidal portion 28 of permanent magnet 10 is shown in comparison with a rectangular component 102 of the permanent magnet 100. A difference in volume of magnetic material is apparent from this comparison which, correspondingly, results in a loss of magnetic field strength. This loss may be determined in rough proportion to the difference in quantity of matter between the trapezoidal portion and the rectangular component 102. This is, in turn, roughly proportional to the disparity between the inner and outer arcs as approximated by equation (1).

$$V_M/V_T=2/(1+R) \tag{1}$$

Where $V_M$, $V_T$ and R are the volume of the pared toroid (permanent magnet 100), the volume of the complete toroid (permanent magnet 10) and the ratio of outer to inner toroidal radius respectively.

Figure 7:
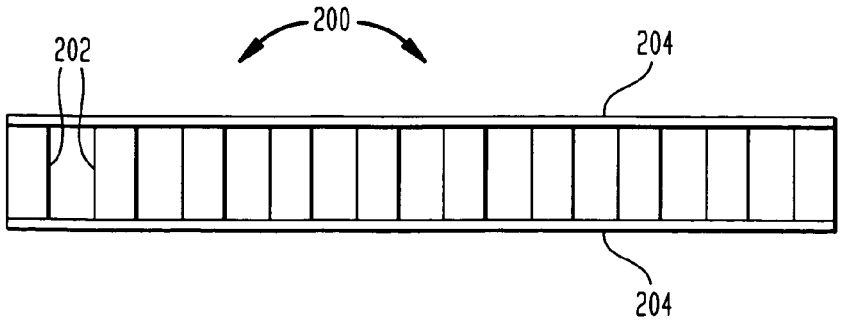
FIG. 7 is a diagram showing a permanent magnet comprising a plurality of components in accordance with a further embodiment of the present invention.

Another embodiment of a permanent magnet, in accordance with the present invention, is illustrated generally at 200 in FIG. 7. As illustrated, the permanent magnet 200 comprises a generally linear configuration rather than the generally toroidal configuration of the permanent magnet 100, described above. The permanent magnet 200 comprises a plurality of components 202, each of which may be similar to the components 102 and thus reference may be had above for further details thereof. Each of the components 102 may be connected together via beams 204 comprising, e.g., an insulating and moldable plastic substance.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

The invention claimed is:

1. A permanent magnet, comprising:

a body having a body axis and comprising a plurality of discreet components, each component being in the shape of a disk and having a generally rectangular shape in cross section and each component being radially spaced from the body axis and also being disposed approximately an equal distance from the body axis and, further, each component being circumferentially spaced an approximately equal distance such that between at least a portion of each component is a space that is generally trapezoidal in cross section, and wherein each of the components comprise a cavity and a component axis, and wherein each of the components further comprise:

an inner ring comprising a magnetic substance and being rotatable about the component axis, the inner ring comprising a plurality of inner segments each having an inner segment magnetic field; and an outer ring also comprising a magnetic substance and being rotatable about the component axis, the outer ring comprising a plurality of outer segments each having an outer segment magnetic field and the outer ring being located in proximity to the inner ring whereby each of the inner segment magnetic fields and the outer segment magnetic fields interact;

wherein each of the components are interconnected together via a moldable plastic substance.

2. The permanent magnet of claim 1, wherein each inner segment has a direction of magnetization that varies such that an angle of magnetization $\gamma$ is twice a local coordinate $\theta$ or $\gamma=2\theta$.

3. The permanent magnet of claim 2, wherein each outer segment has a direction of magnetization that varies such that an angle of magnetization $\gamma$ is twice a local coordinate $\theta$ or $\gamma=2\theta$.

4. The permanent magnet of claim 1, wherein the body comprises a generally toroidal outer configuration.

5. The permanent magnet of claim 1, wherein an outer radius of the inner ring is substantially equal to an inner radius of the outer ring.

6. The permanent magnet of claim 1, wherein a boundary radius (r) defining a boundary between the inner ring and the outer ring is given by $r=(R_O R_I)^{1/2}$, wherein $R_O$=an outer radius of the inner ring and $R_I$=an inner radius of the outer ring.

7. A method of assembling a toroidal magnet, comprising:

forming a plurality of discreet components, each being in the shape of a disk and having a generally rectangular shape in cross section, by:

providing an inner ring comprising a magnetic substance and being rotatable about an inner ring central axis, the inner ring comprising a plurality of inner segments each having an inner segment magnetic field;

providing an outer ring also comprising a magnetic substance and being rotatable about an outer ring central axis, the outer ring comprising a plurality of outer segments each having an outer segment magnetic field and the outer ring being located in proximity to the inner ring whereby each of the inner segment magnetic fields and the outer segment magnetic fields interact;

arranging the plurality of discreet components into a toroidal body that has a body central axis wherein each of the discreet components are radially spaced from the body axis and wherein each are circumferentially spaced an approximately equal distance such that between at least a portion of each component is a space that is generally trapezoidal in cross section, and further wherein each of the components comprise a cavity and a component axis; and fixing the toroidal body via interconnecting the discreet components together with a moldable plastic substance.

8. The method of claim 7, wherein each inner segment has a direction of magnetization that varies such that an angle of magnetization $\gamma$ is twice a local coordinate $\theta$ or $\gamma=2\theta$.

9. The method of claim 8, wherein each outer segment has a direction of magnetization that varies such that an angle of magnetization $\gamma$ is twice a local coordinate $\theta$ or $\gamma=2\theta$.

10. The method of claim 7, wherein an outer radius of the inner ring is substantially equal to an inner radius of the outer ring.

11. The method of claim 7, wherein a boundary radius (r) defining a boundary between the inner ring and the outer ring is given by $r=(R_O R_I)^{1/2}$, wherein $R_O$=an outer radius of the inner ring and $R_I$=an inner radius of the outer ring.

* * * * *